US006901630B2

(12) United States Patent
Liang et al.

(10) Patent No.: US 6,901,630 B2
(45) **Date of Patent: *Jun. 7, 2005**

(54) DOOR CHECK DEVICE

(75) Inventors: Chuan Liang, Scarborough (CA); Gordon A. Paton, Holland Landing (CA)

(73) Assignee: Ventra Group, Inc., Bradford (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/119,292

(22) Filed: Apr. 10, 2002

(65) Prior Publication Data

US 2003/0163895 A1 Sep. 4, 2003

(Under 37 CFR 1.47)

Related U.S. Application Data

(63) Continuation-in-part of application No. 09/733,955, filed on Dec. 12, 2000, now Pat. No. 6,370,733, which is a continuation-in-part of application No. 09/369,317, filed on Aug. 6, 1999, now abandoned.

(60) Provisional application No. 60/095,693, filed on Aug. 7, 1998.

(51) Int. Cl.[7] ..... E05F 1/00

(52) U.S. Cl. ..... 16/82; 16/86 C; 16/86 B; 292/266; 292/262

(58) Field of Search ..... 16/86 C, 82, 86 A, 16/86 B, 255, 286, 97, 333, 334; 292/266, 262, 278, 265

(56) References Cited

U.S. PATENT DOCUMENTS

| | | | | |
|---|---|---|---|---|
| 1,749,573 | A | 3/1930 | Earhart | |
| 2,032,600 | A | 3/1936 | Smith | |
| 2,232,986 | A | 2/1941 | Westrope | |
| 2,290,331 | A | 7/1942 | Jacobs | |
| 2,291,412 | A | 7/1942 | Schonitzer | |
| 2,639,460 | A | 5/1953 | Schonitzer | |
| 3,345,680 | A | 10/1967 | Slattery | |
| 3,905,064 | A | 9/1975 | Brockhaus | |
| 4,788,743 | A | 12/1988 | Okumura | |
| 4,833,755 | A | 5/1989 | Bonin | |
| 4,858,952 | A | 8/1989 | Sasaki et al. | |
| 4,879,785 | A | 11/1989 | Tolle et al. | |
| 5,074,010 | A | 12/1991 | Gignac et al. | |
| 5,112,091 | A | 5/1992 | Klüting | |
| 5,152,030 | A | 10/1992 | Cogo | |
| 5,173,991 | A | 12/1992 | Carswell | |
| 5,474,344 | A | 12/1995 | Lee | |
| 5,509,175 | A | 4/1996 | Baughan et al. | |
| 5,727,287 | A | 3/1998 | Hosken et al. | |
| 5,862,570 | A | 1/1999 | Lezuch et al. | |
| 6,105,208 | A | 8/2000 | Westerdale et al. | |
| 6,370,733 | B2 * | 4/2002 | Paton et al. | 16/86 C |

FOREIGN PATENT DOCUMENTS

| | | |
|---|---|---|
| DE | 1584227 | 8/1970 |

* cited by examiner

*Primary Examiner*—Suzanne Dino Barrett
*Assistant Examiner*—Mark Williams
(74) *Attorney, Agent, or Firm*—Pillsbury Winthrop LLP

(57) ABSTRACT

A door check device includes a first link member engaging structure including a first link member engaging member mounted to a first carrier, a second link member engaging structure including a second link member engaging member mounted to a second carrier, a housing, and an elongated link member. The first engaging structure and the second engaging structure are each constructed and arranged such that, when the link member is caused to undergo a yaw movement relative to the housing generally along a yaw plane that extends in both the transverse direction and the longitudinal extent of the link member, the first and second carriers and the first and second engaging members mounted thereto, respectively, are allowed to rotate relative to the housing along with the link member such that the first and second engaging members remain in transverse relation to the link member.

24 Claims, 8 Drawing Sheets

DOOR CHECK DEVICE

This application is a continuation-in-part of and claims priority to U.S. patent application Ser. No. 09/733,955 filed on Dec. 12, 2000 U.S. Pat. No. 6,370,733, which is a continuation-in-part of and claims priority to U.S. patent application Ser. No. 09/369,317 filed on Aug. 6, 1999 now abandon, which claims priority to U.S. Provisional Application Ser. No. 60/095,693, filed on Aug. 7, 1998, the entirety of each of which is herein incorporated by reference.

FIELD OF THE INVENTION

The present invention relates to a door check device for installation between a motor vehicle body and a motor vehicle door.

BACKGROUND OF THE INVENTION

Door check devices are well-known in the art for use in checking the swinging motion of automotive doors. These devices generally comprise a link member with one or more sets of detents and a housing that contains a pair of spring-biased rolling elements. The link member is inserted through the housing so that the rolling elements are engaged in rolling contact with the surfaces thereof under their respective spring biasing. Either the link member or the housing is secured to the door panel and the other is secured to the motor vehicle body. As the door panel is swung open, the link member moves relative to the housing. When the rolling elements are received within a set of detents on the link member, the detents and rolling elements cooperate to maintain the link member and housing against relative movement until a force sufficient to overcome the biasing on the rolling elements and disengage the rolling elements from the detents is applied to the door panel. As a result, the door check device functions to yieldingly maintain the door panel in position based on the cooperation between the rolling elements and the detents.

Alternatively, some prior art door check devices use non-rotatable structures that slidably engage opposing sides of the link member. One or both of these fixed structures may be spring-biased against the link member in a manner similar to the roller-type arrangement mentioned above. For an example of such a device, one may refer to U.S. Pat. No. 5,862,570.

A major drawback of these types of devices is that the link member may be allowed to pivot or otherwise shift or move relative to the housing in a yaw-type movement. As a result of such movement, the transverse detents can become misaligned with respect to the orientation of the rollers/sliders. This misalignment can lead to uneven wear on the rollers/sliders and/or the link arm. Also, if enough free play is permitted, this misalignment may cause the door check device to become inoperable because the rollers/sliders are unable to be received within the detents.

Consequently, it would be advantageous to provide an improved door check device that obviates the shortcomings associated with the prior art door check devices discussed above.

SUMMARY OF THE INVENTION

In accordance with the principles of the present invention, this objective is achieved by providing a door check device for installation between a motor vehicle body and a motor vehicle door that swings in opposing opening and closing directions relative to the vehicle body. The door check device includes a first link member engaging structure, a second link member engaging structure including a second link member engaging member mounted to a second carrier, and a housing having a connecting portion. The door check device further includes an elongated link member having a first opposing end that provides a connecting portion, a second opposing end, and an intermediate portion that extends between the first and second opposing ends thereof. The link member provides first and second opposing face surfaces, the intermediate portion having upper and lower detents that extend generally in a transverse direction of the link member on the first and second opposing face surfaces thereof, respectively. The elongated link member is positioned between the first and second engaging members of the first and second engaging structures with the first and second engaging structures extending generally in the transverse direction of the link member such that the first and second engaging members face the first and second face surfaces, respectively, of the intermediate portion. A biasing structure is constructed and arranged to bias the first and second engaging structures relatively towards one another to thereby urge the first and second engaging structures into engagement with the first and second opposing face surfaces of the intermediate link member portion, respectively. The connecting portion of the elongated link member and the connecting portion of the housing are constructed and arranged to enable installation of the door check device by operatively connecting one of the connecting portions to the vehicle door and operatively connecting the other of the connecting portions to the vehicle body. Opening and closing movements of the vehicle door relative to the vehicle body moves the link member relative to the housing with the first engaging structure travelling along the first face surface of the link member's intermediate portion and the second engaging structure travelling along the second face surface of the link member's intermediate portion. The first and second engaging members and the detent regions are configured with respect to one another such that, when the device is installed as aforesaid and the vehicle door is swung to a location with respect to the vehicle body wherein the first and second engaging members are received within the upper and lower detents, respectively, the first and second engaging structures cooperate with the upper and lower detents to maintain the vehicle door at that position until a force sufficient to cause the link member to move relative to the housing so as to urge the first and second engaging structures relatively apart from one another and out of cooperation with the upper and lower detents against the biasing of the biasing structure is applied to the vehicle door. The first engaging structure and the second engaging structure are each constructed and arranged such that, when the link member is caused to undergo a yaw movement relative to the housing generally along a yaw plane that extends in both the transverse direction and the longitudinal extent of the link member, the first and second engaging structures are allowed to rotate relative to the housing along with the link member such that the first and second engaging structures remain in transverse relation to the link member.

In accordance with another aspect of the present invention, the link member inflicts a torque on the first and second engaging members to cause the first and second engaging members to rotate together with the link member as the link member undergoes yaw movement. Further, the first and second face surfaces are essentially flat and wherein friction between the first and second engaging members and the first and second face surfaces, respectively, of the link member due to the biasing force from the biasing structure is sufficient to cause the first and second engaging members to rotate together with the link member as the link member undergoes yaw movement.

In the parent application (Ser. No. 09/733,955), one embodiment of the door check device includes hour-glass shaped rollers that engage a complementary shaped link member with convex face surfaces. The complementary relationship tends to restrict relative transverse movement between the link member and the rollers during opening and closing movements of the vehicle door. However, manufacturing tolerances make it somewhat expensive to form the convex face surfaces with a consistent curvature, which is desirable for operational consistency of the door check devices.

The door check device of this aspect of the invention is easier to manufacture and more cost effective than this type of door check device in the parent application because creating the flat surfaces within appropriate tolerances is significantly less expensive than forming convex surfaces. It should be noted that although this aspect of the invention is believed to be advantageous over the embodiment mentioned above from the parent application, the broader aspects of the present invention are intended to cover the embodiment of the parent application and no admission of prior art should be construed from this discussion.

Preferably, the door check device of the present invention includes first and second carriers that rotate together relative to the housing along with the link member such that the first and second engaging members remain in transverse relation to the link member.

These and other objects, features, and advantages of this invention will become apparent from the following detailed description when taken into conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF PREFERRED EMBODIMENTS

Figure 1:
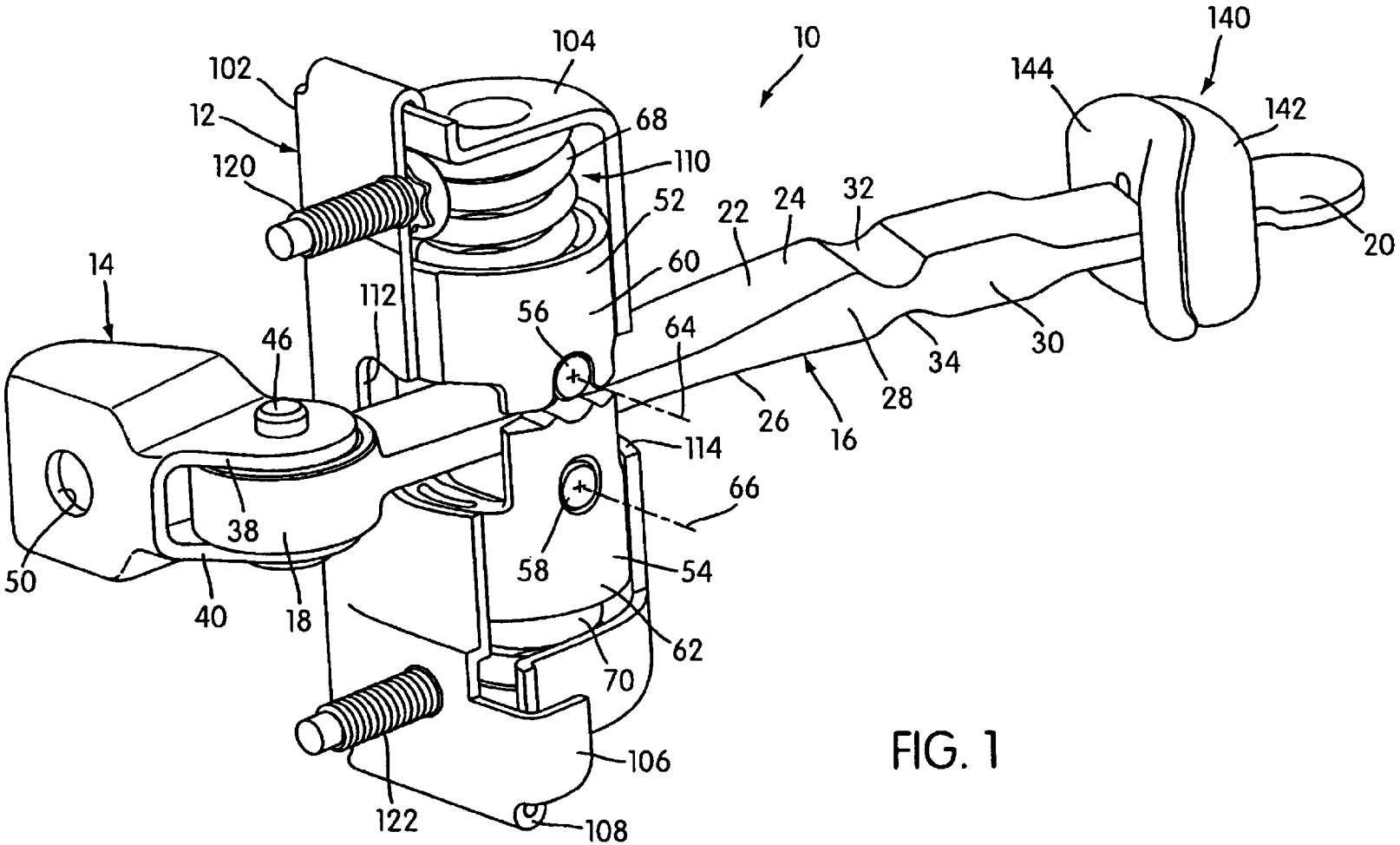
FIG. 1 is a perspective view of a door check device with a portion of the housing removed for clarity purposes.
Figure 2:
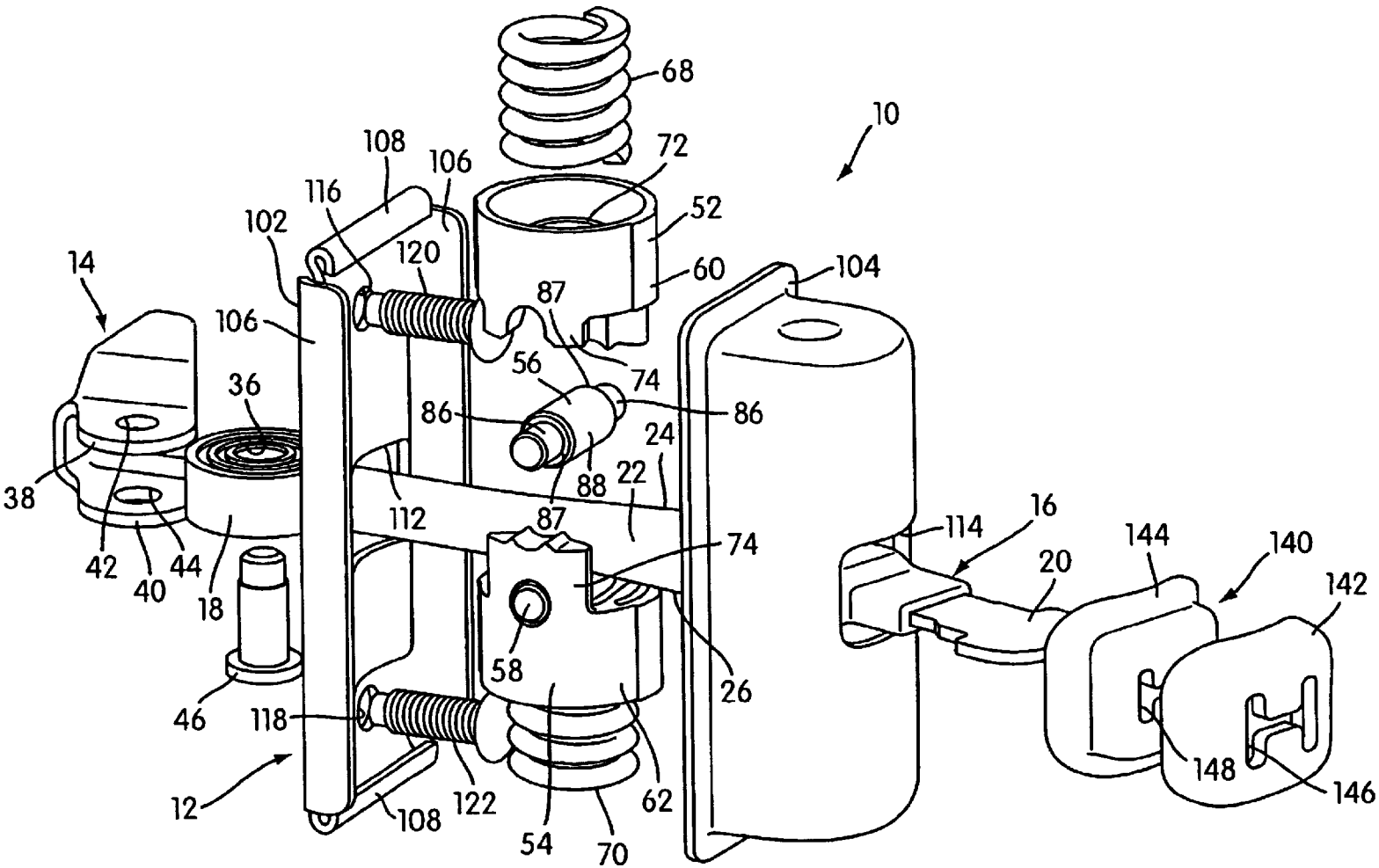
FIG. 2 is an exploded view of the door check device of FIG. 1.
Figure 3:
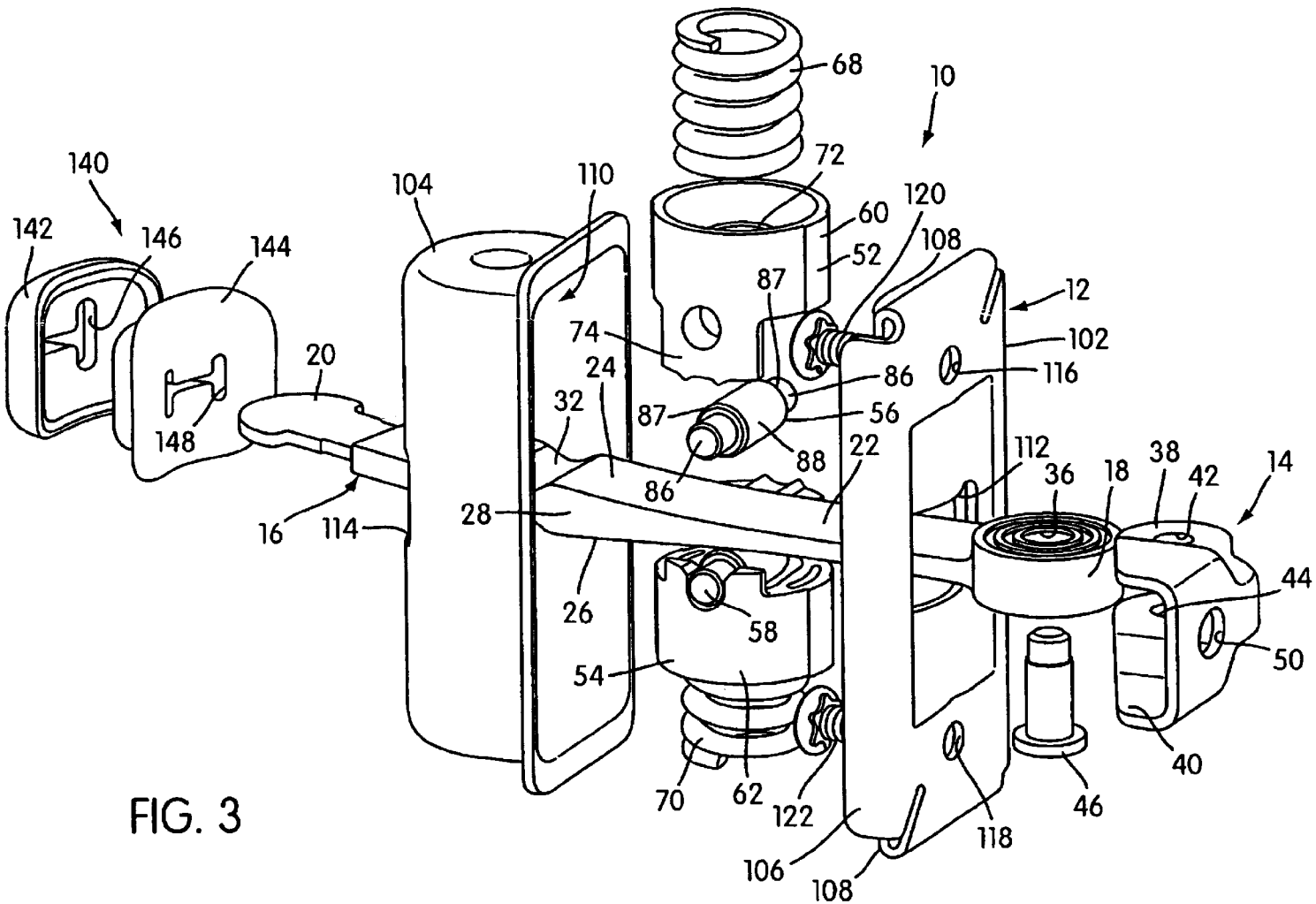
FIG. 3 is an exploded view of the door check device of FIG. 1.

FIGS. 1–3 show a door check device 10 for installation between a motor vehicle body and a motor vehicle door that swings in opposing opening and closing directions relative to the vehicle body. The construction of the motor vehicle and the door thereof are not considered to be part of the present invention and thus will not be detailed herein. Instead, the present invention is concerned in detail with the door check device 10.

The door check device 10 includes a first mounting structure 12 constructed and arranged to be mounted to the vehicle door and a second mounting structure 14 constructed and arranged to be mounted on the vehicle body such that the first and second mounting structures 12, 14 move relative to one another as the door is swung in the opposing opening and closing directions thereof relative to the vehicle body.

The mounting structures 12, 14 are referred to as "first" and "second" mounting structures to reflect the fact that the door check device 10 may be installed either by mounting the first mounting structure 12 to the vehicle door and the second mounting structure 14 to the vehicle body or by mounting the first mounting structure 12 to the vehicle body and the second mounting structure 14 to the vehicle door. In the illustrated embodiment, the first mounting structure 12 constitutes a housing and is constructed and arranged to be mounted within the interior of the vehicle door and the second mounting structure 14 is constructed and arranged to be mounted to the vehicle body.

An elongated link member 16 has a first opposing end that provides a connecting portion 18 and a second opposing end that provides a stop portion 20. An intermediate portion 22 of the link member extends between the first and second opposing ends and provides first and second opposing face surfaces 24, 26.

The link member 16 further includes a first ramp portion 28 and a second ramp portion 30 that are formed adjacent each other. More specifically, the first and second ramp portions 28, 30 each have a larger cross-sectional size than the remainder of the link member's intermediate portion 22 and have upper and lower detents 32, 34 defined therebetween. In the illustrated embodiment, the first and second face surfaces 24, 26 are essentially flat.

The link member 16 extends through the housing 12 and the connecting portion 18 thereof, which has a bore 36 therethrough, is pivotally connected to the second mounting structure 14. In the illustrated embodiment, the second mounting structure 14 has two arms 38, 40 with pivot pin receiving bores 42, 44, used to pivotally connect with the connecting portion 18 via a stepped pivot pin 46. Specifically, the second mounting structure 14 and the connecting portion 18 of the link member 16 are pivotally connected by aligning bores 36, 42, 44 with the connecting portion 18 between the two arms 38, 40 and inserting the pivot pin 46 therethrough. The second mounting structure 14 also has a bore 50. The second mounting structure 14 is mounted to the vehicle body by use of a bolt inserted through bore 50. Alternatively, the bore 50 may be omitted and the second mounting structure 14 may be mounted to the vehicle body by welding.

The link member 16 is received between a first link member engaging structure 52 and a second link member engaging structure 54 which are contained within the first mounting structure 12. The first and second face surfaces 24, 26 of the link member 16 interface with and contact contacting surfaces of the first and second link member engaging structures 52, 54, respectively. Thus, as the vehicle door is swung in the opposing opening and closing directions thereof relative to the vehicle body, the link member 16 moves relative to the housing 12 with the first engaging structure 52 travelling along the first face surface 24 of the link member's intermediate portion 22 and the second engaging structure 54 travelling along the second face surface 26 of the link member's intermediate portion 22.

In the illustrated embodiment, the first and second link member engaging structures 52, 54 include first and second link member engaging members 56, 58 mounted to first and second cylindrical carriers 60, 62, respectively. In the illustrated embodiment, the first and second engaging members 56, 58 are first and second cylindrical rollers rotatably mounted to the first and second carriers 60, 62, respectively. The rollers 56, 58 are mounted to respective roller carriers 60, 62 for rotation about first and second rotational axes 64, 66, respectively, which are generally parallel to the transverse direction of the link member 16. Alternatively, the engaging members 56, 58 may be non-rolling sliding structures that frictionally slide along the opposing face surfaces 24, 26 of the link member 16. Further, although in the illustrated embodiment the first and second rollers 56, 58 are generally cylindrical, it should be understood that the present invention is not specifically limited to such rollers. For example, the rollers 56, 58 may be spherical or ovoid rollers or any other structure suitable for cooperating with the link member 16.

The rollers 56, 58 are biased to remain in rolling engagement with respective first and second face surfaces 24, 26 of the link member 16 with the use of a biasing structure that includes a pair of biasing elements in the form of coil springs 68, 70 contained within the housing 12. The coil springs 68, 70 contact the roller carriers 60, 62 to affect the biasing of the rollers 56, 58, respectively. As a result of this rolling engagement, the rollers 56, 58 rotate about the respective first and second rotational axes 64, 66 thereof as the link member 16 is moved relative to the first mounting structure 12.

It is not necessary to use a pair of coil springs 68, 70 as the biasing structure to urge the rollers 56, 58 relatively towards one another and into engagement with the first and second face surfaces 24, 26 of the link member 16. A single coil spring could be used to bias one roller relative to the other roller, which remains unbiased and may be fixed against movement toward and away from the link member 16. However, any suitable arrangement for urging the rollers 56, 58 relatively towards one another is acceptable.

In the illustrated embodiment, the first and second link member engaging structures 52, 54 are identical to one another. Because the first and second engaging structures 52, 54 are similar, an understanding of the configuration of the first engaging structure 52 will suffice for an understanding of both.

Referring now more particularly to FIGS. 4–7, the roller carrier 60 of the first engaging structure 52 has a generally cylindrical exterior shape and this is generally circular in a cross-section taken perpendicular to its pivoting axis. The roller carrier 60 has a spring bearing portion 72 which contacts the coil spring 68 and thus serves as a platform for the coil spring 68 to sit on. The roller carrier 60 also has a roller mounting portion 74 for mounting its corresponding roller 56.

Figure 4:
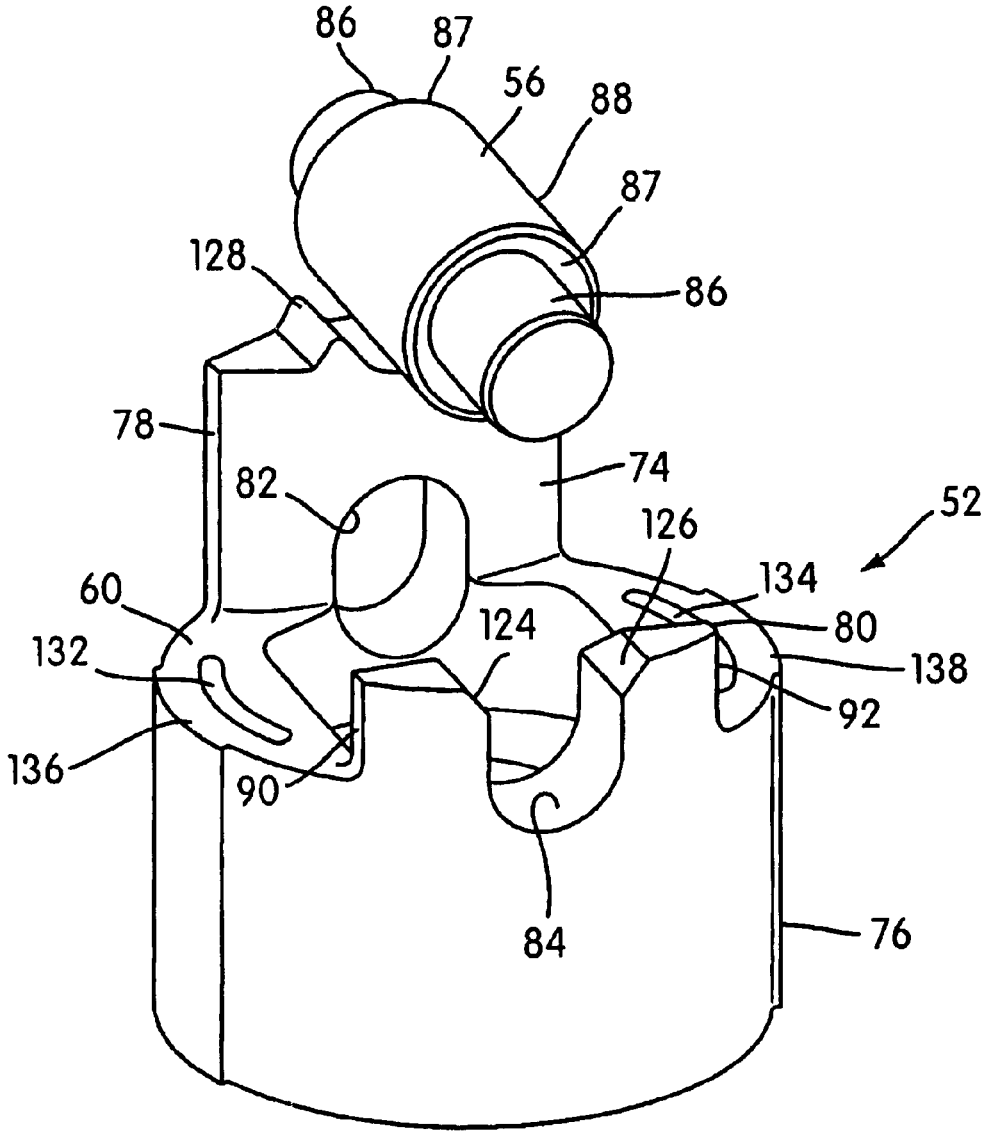
FIG. 4 is a perspective view of a roller and a roller carrier.
Figure 5:
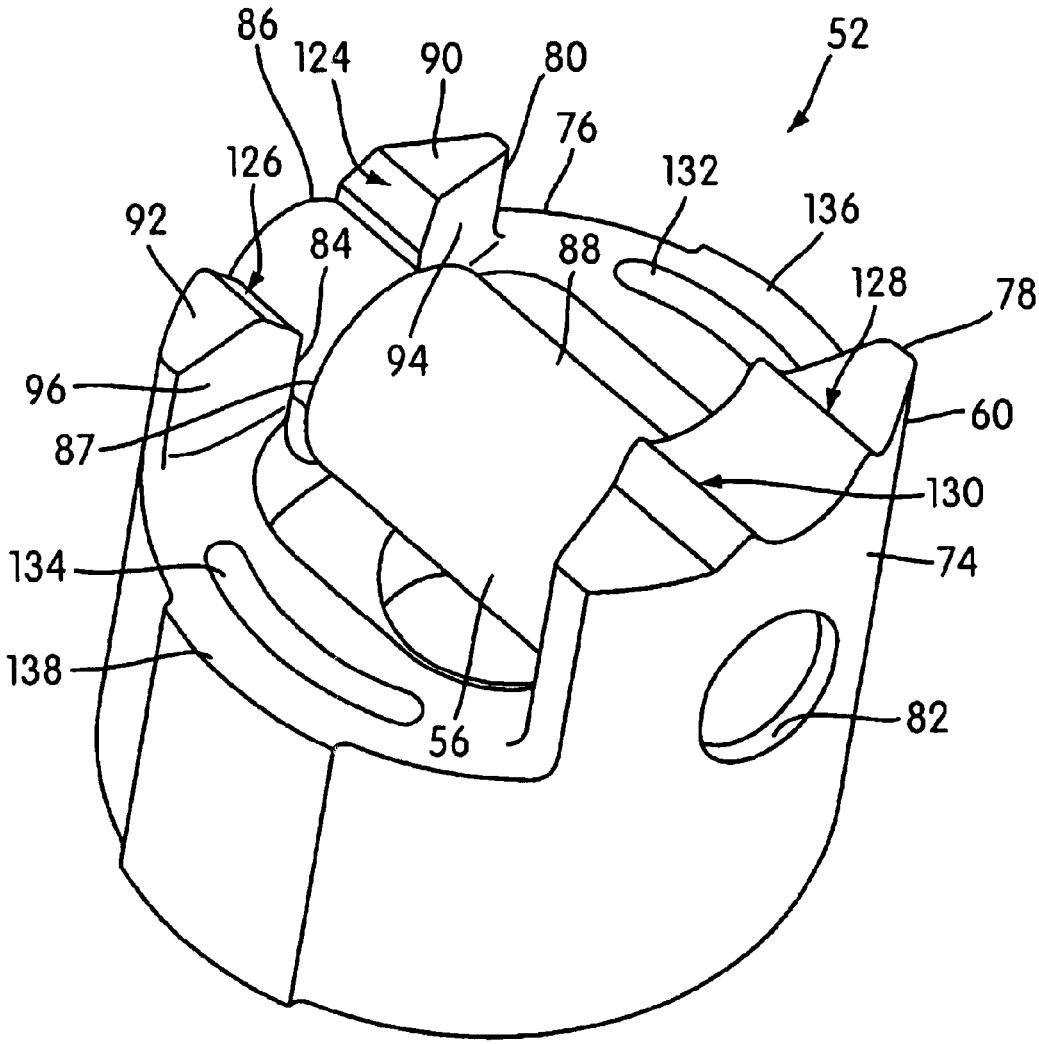
FIG. 5 is a perspective view of a roller contained in a roller carrier.
Figure 6:
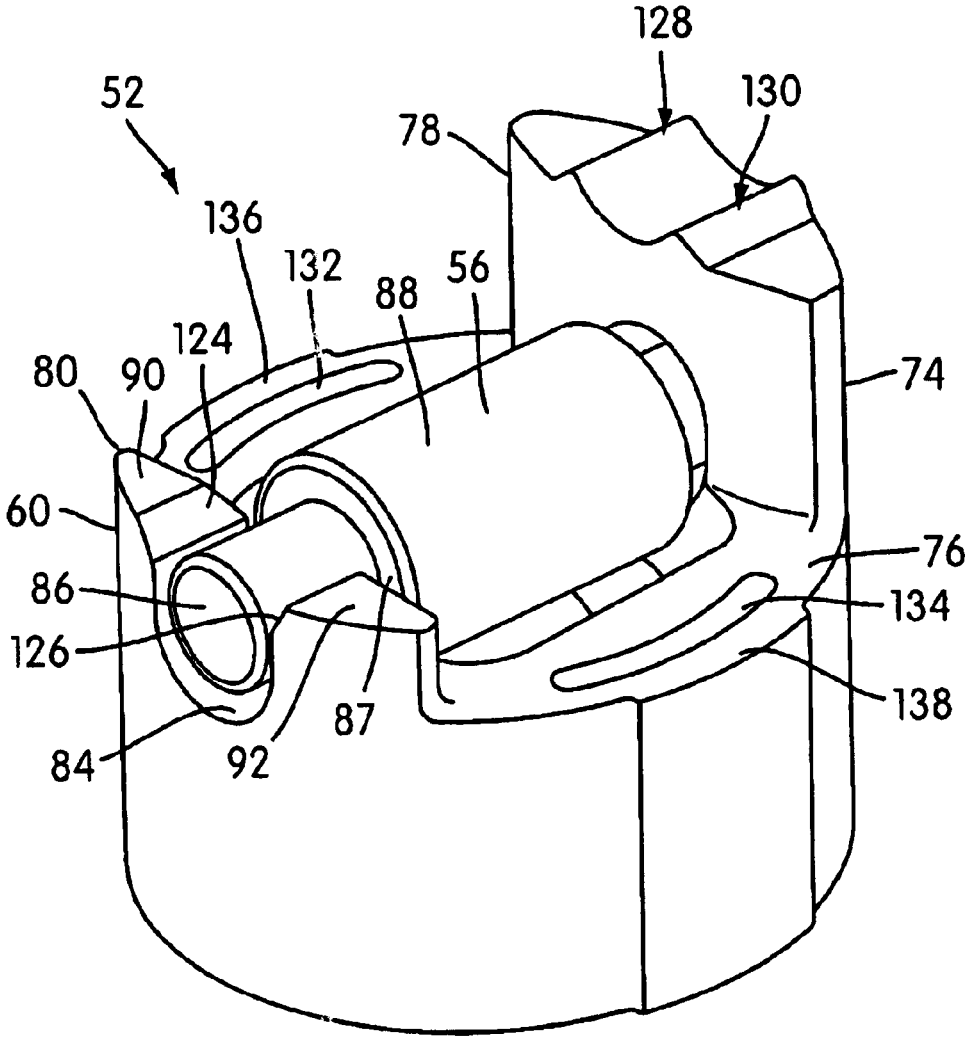
FIG. 6 is a perspective view of a roller contained in a roller carrier.

As shown in FIGS. 4–6, the roller carrier 60 includes an annular wall 76 surrounding a spring receiving space. A first post member 78 and a second post member 80 extend generally in an axial direction from the wall 76. The first and second post members 78, 80 are continuous with the annular wall 76 and are generally diametrically opposed to one another. The first post member 78 has a greater longitudinal extent than the second post member 80. The first post member 78 provides a roller receiving opening 82 therethrough and the second post member 80 provides a roller receiving concave recess 84.

The roller 56 has a stepped configuration with axles 86 formed at opposing ends thereof along the first rotational axis 64. Specifically, the opposing ends of the roller 56 have a smaller cross sectional dimension than the intermediate portion 88 therebetween. The intermediate portion 88 of the roller 56 provides the contacting surfaces that interface with and contact the first and second face surfaces 24, 26 of the link member 16. Further, the roller 56 has a stepped portion 87 between each of the axles 86 and the intermediate portion 88. The stepped portion 87 includes a chamfer and a vertical face surface.

The roller 56 is rotatably mounted to the first roller carrier 60 by inserting one of the axles 86 within the roller receiving opening 82 provided in the first post member 78 and inserting the other axle 86 into the roller receiving concave recess 84 provided in the second post member 80. Specifically, the second post member 80 includes opposing leg portions 90, 92 that define the recess 84 therebetween. During assembly, one of the axles 86 is inserted within the roller receiving opening 82 and the other axle 86 is moved into engagement with opposing chamfers 94, 96 provided on the leg portions 90, 92. More specifically, the stepped portion 87, adjacent the axle 86, is moved into engagement with the opposing chamfers 94, 96. As the roller 56 is moved into the recess 84, the stepped portion 87 slides in a camming action along the chamfers 94, 96, which in turn flexes the leg portions 90, 92 outwardly away from one another, thereby allowing the axle 86 of the roller 56 to move into the mounted position shown in FIGS. 5 and 6. Thereafter, the leg portions 90, 92 resiliently return inwardly toward one another with a snap-action to secure the roller 56 in the mounted position. The roller 56 may be removed by pulling in an opposite direction to flex out the leg portions 90, 92 so as to withdraw the roller 56 from the recess 84. When mounted, the roller 56 rotates about the first rotational axis 64 relative to the carrier 60, but does not otherwise move relative to the carrier 60. The roller 56 is permitted to be snap fit into the carrier 60 due to the longer and shorter post configuration. The stepped configuration of the roller 56 also facilitates rotation of the roller about the first rotational axis 64.

Figure 7:
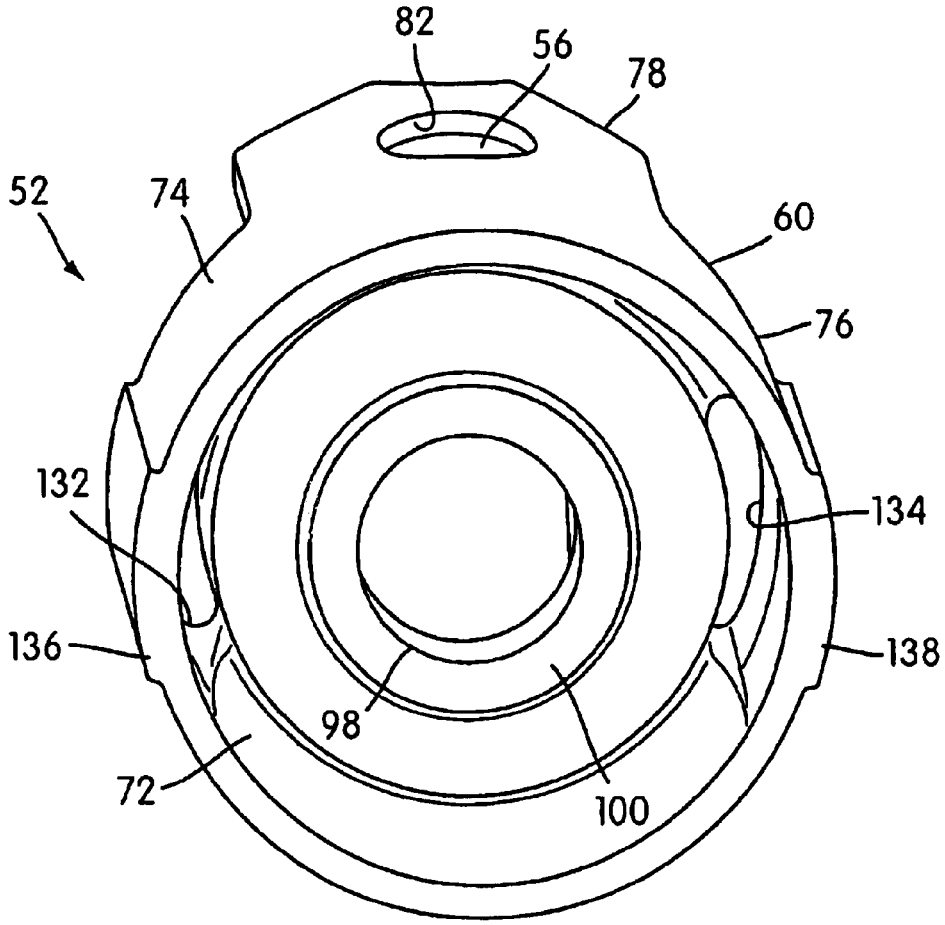
FIG. 7 is a perspective view illustrating the bottom of a roller carrier.

As illustrated in FIG. 7, the spring bearing portion 72 includes a cylindrical base 98 received within the spring receiving space provided by the annular wall 76 and having peripheral edges connected to the interior surface of the annular wall 76. The cylindrical base 98 includes an annular protrusion 100, which is used to locate the corresponding coil spring 68. The coil spring 68 is sized such that the exterior periphery of the coil spring 68 fits in close relation against the interior surface of the annular wall 76 and the interior periphery of the coil spring 68 fits in close relation to the exterior of the annular protrusion 100.

The housing 12 has a connecting portion 102 and a case portion 104. The connecting portion 102 is stamped from a piece of sheet metal and then folded or otherwise deformed in a conventional manner to provide the connecting portion 102 with a pair of generally parallel opposing walls 106 and a pair of opposing retaining portions 108. The case portion 104 is in the form of an open-ended container that includes a cylindrical interior space 110 for containing the first and second engaging structures 52, 54 and the coil springs 68, 70. The connecting portion 102 and the case portion 104 also include aligned openings 112, 114 through which the link member 16 is passed.

The connecting portion 102 has aligned and spaced apart generally circular holes 116, 118 that are bored or stamped therethrough. The housing 12 is mounted within the interior of the vehicle door by use of mounting bolts 120, 122 inserted through these bored holes 116, 118 in the connecting portion 102. Alternatively, these holes 116, 118 may be omitted and the connecting portion 102 may be mounted by welding.

The case portion 104, with the first and second engaging structures 52, 54 and the coil springs 68, 70 contained therein, is secured to the connecting portion 102 by positioning the case portion 104 between the opposing walls 106 and securing opposing edges of the case portion 104 to the retaining portions 108. The retaining portions 108 clamp the case portion 104 to the connecting portion 102.

Figure 8:
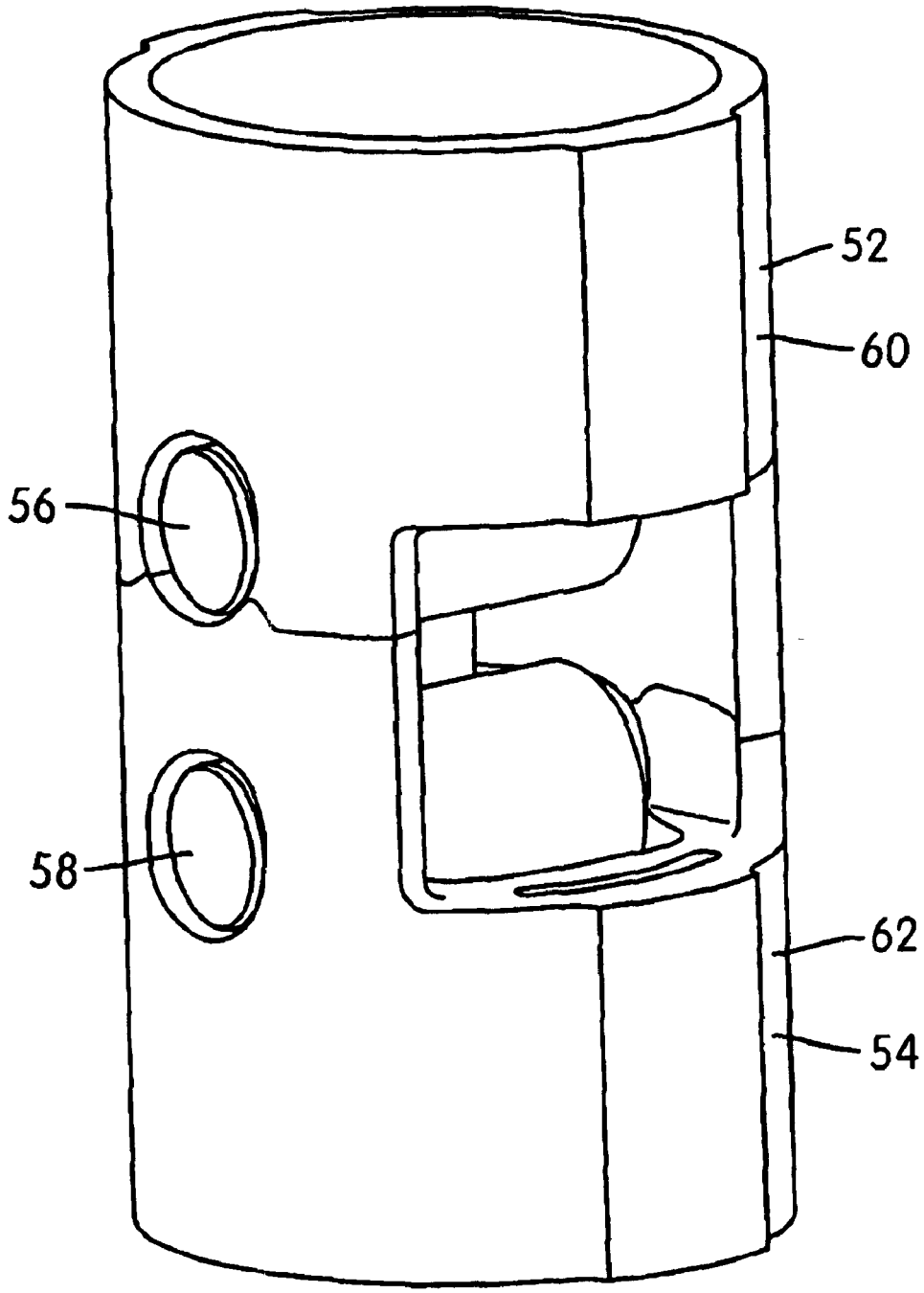
FIG. 8 is a perspective view of first and second roller carriers engaged in interlocking relation with one another.

The roller carriers 60, 62 are engaged with one another in interlocking relation (as shown in FIG. 8) when they are mounted within the case portion 104. Specifically, the first post member 78 of each carrier 60, 62 includes opposing chamfers 124, 126 adjacent the recess 84 and the second post member 80 of each carrier 60, 62 includes opposing protrusions 128, 130. When the roller carriers 60, 62 are engaged with one another as illustrated in FIG. 8, the first post member 78 of each carrier 60, 62 engages the second post member 80 of the opposing carrier 60, 62 with the protrusions 128, 130 received between the chamfers 124, 126 in interlocking relation. As a result, the roller carriers 60, 62 will pivot together when the roller carriers 60, 62 are mounted within the case portion 104 with the coil springs 68, 70.

Moreover, the annular wall 76 of each roller carrier 60, 62 includes diametrically opposed slots 132, 134 and protrusions 136, 138. The slots 132, 134 and protrusions 136, 138 are positioned between the first and second post members 78, 80. The slot and protrusion configuration enables the roller carriers 60, 62 to fit securely within the case portion 104 even when the tolerances are loose or the carriers 60, 62 have been worn. The slot and protrusion configuration permits the annular wall 76 to flex inwardly as the carriers 60, 62 are mounted within the case portion 104 in order to achieve sufficient interference with the interior surface of the case portion 104. Specifically, the protrusions 136, 138 protrude outwardly from the annular wall 76 such that a diameter of each carrier 60, 62 is larger than a diameter defined by the interior surface of the case portion 104. Thus, when the carriers 60, 62 are mounted within the case portion 104, the protrusions 136, 138 of each carrier are in continuous engagement with the interior surface of the case portion 104.

Because the carriers 60, 62 are identical to one another, assembly and manufacturing is made easier. The longer and shorter post configuration of the carriers 60, 62 also facilitates assembly. Moreover, the interlocking engagement of the carriers 60, 62 prevents any misalignment between the carriers 60, 62 when they are mounted within the case portion 104.

The case portion 104 may include annular protrusions on opposing interior walls thereof in order to locate corresponding coil springs 68, 70.

The link member 16 further includes a stopping assembly 140 provided at the stop portion 20 thereof. The stopping assembly 140 includes a rigid mounting structure 142 and a cushioning structure 144. The mounting structure 142 and the cushioning structure 144 each have respective openings 146, 148 therethrough. The mounting structure 142 and the cushioning structure 144 are engaged with one another and the stop portion 20 of the link member 16 is inserted through the aligned openings 146, 148 thereof to secure the stopping assembly 140 to the stop portion 20. The stopping assembly 140 prevents the link member 16 from being withdrawn from between the roller carriers 60, 62. Also, when the door check device 10 is installed and the vehicle door is swung to its fully open position, the stopping assembly 140 will prevent the vehicle door from moving beyond the fully open position thereof. Specifically, the cushioning structure 144 of the stopping assembly 140 will engage the case portion 104 to prevent any further movement. Further, the cushioning structure 144 is formed from a polymeric material which will cushion the impact and prevent impact noise. Usually, the stopping assembly 140 is used in conjunction with a stop provided on the vehicle door's hinge.

FIG. 1 illustrates an assembled door check device 10, which will check the closing position of the vehicle door in relation to the vehicle body.

As the link member 16 is moved in the longitudinal direction thereof due to vehicle door opening and closing movements, the rollers 56, 58 roll along the face surfaces 24, 26 of the link member 16 in generally perpendicular relation and will accommodate any relative yaw movement of the link member 16 by turning in corresponding yaw movements along with the link member 16.

Specifically, because the carriers 60, 62 have a cylindrical exterior shape, the carriers 60, 62 are able to rotate relative to the first mounting structure 12 (within the case portion 104). This permits the rollers 56, 58 mounted to the carriers 60, 62 to be maintained in proper alignment with respective face surfaces 24, 26 of the link member 16 as the link member 16 causes the relative yaw position of the first mounting structure 12 to change with respect to the link member 16 that is passing through the first mounting structure 12. Thus, the carriers 60, 62 pivot together relative to the first mounting structure 12 to permit the rollers 56, 58 to remain perpendicular to the link member 16 as it shifts in a yaw-type manner.

Specifically, as the link member 16 shifts in a yaw-type manner, the distribution of force transmitted to the rollers 56, 58 along a contact line (due to the frictional engagement between the rollers 56, 58 and the link member 16) becomes offset from the transverse axis of the rollers 56, 58 which causes the link arm 16 to inflict a torque on the rollers 56, 58 and hence the carriers 60, 62 to pivot the rollers 56, 58 and the carriers 60, 62 with the link member 16. Further, the friction between the rollers 56, 58 and the link member 16 due to the load from the coil springs 68, 70 is sufficient to cause the rollers 56, 58 to rotate together with the link member 16 as it undergoes yaw movement. Specifically, the frictional characteristics (i.e., coefficient of friction) of the link member 16 and the rollers 56, 58 is selected in such a way that they will effectively remain engaged in perpendicular relation as the link member 16 undergoes yaw movement.

The term "yaw" in the context of the present subject matter is used to describe the movement that the link member 16 may undergo relative to the first mounting structure 12 generally along a yaw plane that is defined as extending along both the transverse direction and the longitudinal extent of the link member 16. This yaw movement of the link member 16 can occur as a result of the path along which the vehicle door swings. Also, this movement can occur as a result of free play being permitted between the connection of the first mounting structure 12 and the second mounting structure 14 of the link member 16 to the vehicle body and the vehicle door.

By allowing the carriers 60, 62 to move along with the link member 16 in its yaw movement, the carriers 60, 62 and the rollers 56, 58 therein can remain in their respective movement restricting relationships with the face surfaces 24, 26. Additionally, the upper and lower detents 32, 34 will not become misaligned with respect to the rollers 56, 58.

Further, the rotating carriers 60, 62 allow the rollers 56, 58 mounted thereto to find a line of contact with the link member 16 that extends substantially perpendicular to the link member 16 as the link member 16 moves throughout the vehicle door swing. Thus, contact pressure is distributed evenly along the contact line so wearing between the link member 16 and the rollers 56, 58 is reduced. It should be noted that the contact line may actually be a surface due to the material deformation under load from the coil springs 68, 70.

Continued movement of the link member 16 relative to the first mounting structure 12 causes the rollers 56, 58 to contact the first ramp portion 28 and then roll up the first ramp portion 28. As the rollers 56, 58 roll up the first ramp portion 28, the riding movement of the rollers 56, 58 in a direction away from the link member 16 deflects the coil springs 68, 70. As the deflection of the coil springs 68, 70 increases, the resistance they provide to door movement likewise increases. As the rollers 56, 58 pass over the apexes of the first ramp portion 28 the increased biasing force in coil springs 68, 70 biases the rollers 56, 58 into engagement with the link member 16 in a cooperating relation with the upper and lower detents 32, 34. This is the checked position.

The rollers 56, 58 are constructed and arranged such that when the vehicle door is swung to the checked position with respect to the vehicle body with the rollers 56, 58 received within the upper and lower detents 32, 34, the rollers 56, 58 and the detents 32, 34 cooperate to maintain the vehicle door at this checked position until a force is applied to the door sufficient to cause the link member 16 to move relative to the rollers 56, 58 so as to urge the rollers 56, 58 generally apart from one another against the biasing of the coil springs 68, 70, thus moving the rollers 56, 58 out of their respective detents 32, 34. Specifically, the door check device 10 functions to maintain the checked position until the force applied to the vehicle door is sufficient to move the link member 16 relative to the rollers 56, 58 so as to cause the rollers 56, 58 to ride up one of the first and second ramp portions 28, 30 and over the apexes thereof against the resistance of the coil springs 68, 70. The force required to cause the rollers 56, 58 to ride up one of the first and second ramp portions 28, 30 is determined by the spring constant and the heights and geometries of the first and second ramp portions 28, 30. The link member 16 may include more than one pair of upper and lower detents to provide more than one checked position.

It should be noted that the carriers do not necessarily have to have a cylindrical shape. The carriers may have any shape that permits the carrier to rotate relative to the housing during yaw movement of the link member. For example, the carrier may be square-shaped and positioned within cylindrical housing such that it may rotate relative to the housing. Likewise, the spaces in the housing in which the carriers are received may have a square shape while the carriers have a cylindrical shape. Further, the carriers may have curved surfaces configured and positioned to allow the carriers to rotate during the yaw movement of the link member. However, it is preferred that both the carriers and the spaces in which they are received have a cylindrical shape.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A door check device for installation between a motor vehicle body and a motor vehicle door that swings in opposing opening and closing directions relative to the vehicle body, said door check device comprising:

a first link member engaging member;

a second link member engaging member;

a housing having a connecting portion;

an elongated link member having a first opposing end that provides a connecting portion, a second opposing end, and an intermediate portion that extends between said first and second opposing ends thereof and provides first and second opposing face surfaces, said intermediate portion having upper and lower detents that extend generally in a transverse direction of said link member on said first and second opposing face surfaces thereof, respectively;

said elongated link member being positioned between said first and second engaging members with said first and second engaging members extending generally in the transverse direction of said link member such that said first and second engaging members face the first and second face surfaces, respectively, of said intermediate portion;

biasing structure constructed and arranged to bias said first and second engaging members relatively towards one another to thereby urge said first and second engaging members into engagement with the first and second opposing face surfaces of said intermediate link member portion, respectively;

the connecting portion of said elongated link member and the connecting portion of said housing being constructed and arranged to enable installation of said door check device by operatively connecting one of said connecting portions to the vehicle door and operatively connecting the other of said connecting portions to the vehicle body so that opening and closing movements of the vehicle door relative to the vehicle body moves said link member relative to said housing with said first engaging member travelling along the first face surface of said link member's intermediate portion and said second engaging member travelling along the second face surface of said link member's intermediate portion;

said first and second engaging members and said detent regions being configured with respect to one another such that, when said device is installed as aforesaid and the vehicle door is swung to a location with respect to the vehicle body wherein said first and second engaging members are received within said upper and lower detents, respectively, said first and second engaging members cooperate with said upper and lower detents to maintain the vehicle door at that position until a force sufficient to cause said link member to move relative to said housing so as to urge said first and second engaging members relatively apart from one another and out of cooperation with said upper and lower detents against the biasing of said biasing structure is applied to the vehicle door;

said first engaging member and said second engaging member each being rotatable generally parallel to a yaw plane that extends in both the transverse direction and the longitudinal extent of said link member such that, when said link member is caused to undergo a yaw movement relative to said housing generally along said yaw plane, said first and second engaging members are allowed to rotate relative to the housing along with said link member such that the first and second engaging members remain in transverse relation to said link member.

2. The door check device according to claim 1, further comprising:

a first carrier rotatably mounted to said housing with said first engaging member mounted to said first carrier, and a second carrier rotatably mounted to said housing with said second engaging member mounted to said second carrier.

3. The door check device according to claim 2, wherein the first and second engaging members are first and second cylindrical rollers rotatably mounted to the first and second carriers, respectively.

4. The door check device according to claim 3, wherein the first and second rollers are mounted to respective carriers for rotation about first and second rotational axes, respectively, which are generally parallel to a transverse direction of the link member.

5. The door check device according to claim 2, wherein the first and second carriers have a generally cylindrical exterior shape.

6. The door check device according to claim 5, wherein each carrier includes an annular wall with a first post member and a second post member extending generally in an axial direction from the annular wall.

7. The door check device according to claim 6, wherein the first post member and the second post member are diametrically opposed to one another.

8. The door check device according to claim 6, wherein one of the first and second post members has a greater longitudinal extent than the other of the first and second post members.

9. The door check device according to claim 6, wherein the first and second post members are configured and positioned to mount the corresponding engaging member.

10. The door check device according to claim 9, wherein the first and second engaging members are first and second cylindrical rollers rotatably mounted to the first and second carriers, respectively.

11. The door check device according to claim 10, wherein the first and second rollers have a stepped configuration with axles formed at opposing ends thereof.

12. The door check device according to claim 11, wherein one of the axles of each roller is inserted within a roller receiving opening provided in one of the first and second post members and the other axles is inserted into a roller receiving concave recess provided in the other of the first and second post members with a snap-action.

13. The door check device according to claim 6, wherein the first and second carriers are engaged with one another in interlocking relation when mounted within the housing.

14. The door check device according to claim 13, wherein one of the first and second post members of each carrier includes opposing chamfers and the other of the first and second post members includes opposing protrusions, the first and second roller carriers being engaged with one another such that the first post member of one carrier engages the second post member of the opposing carrier with the protrusions received between the chamfers in interlocking relation.

15. The door check device according to claim 2, wherein the housing includes a casing portion having a cylindrical interior space for rotatably containing the first and second engaging carriers.

16. The door check device according to claim 2, wherein each carrier includes an annular wall, the annular wall including diametrically opposed slots and protrusions that permit the annular wall to flex inwardly as the first and second carriers are mounted within the case portion.

17. The door check device according to claim 2, wherein the first and second carriers rotate together relative to the housing with the link member such that the first and second engaging members remain transverse relation to the link member.

18. The door check device according to claim 2, wherein the biasing structure includes a pair of biasing elements in the form of coil springs contained within the housing.

19. The door check device according to claim 18, wherein each carrier has a spring bearing portion which contacts the corresponding coil spring and a mounting portion which mounts the corresponding engaging member.

20. The door check device according to claim 1, wherein said link member inflicts a torque on the first and second engaging members to cause the first and second engaging members to rotate together with the link member as the link member undergoes yaw movement.

21. The door check device according to claim 20, wherein said the opposing face surfaces of said link member are essentially flat, except for said detent regions.

22. The door check device according to claim 1, wherein the first and second engaging members are non-rolling sliding structures.

23. The door check device according to claim 1, wherein the biasing structure includes a pair of biasing elements in the form of coil springs contained within the housing.

24. The door check device according to claim 1, wherein the first and second engaging members are identical to one another.

* * * * *